United States Patent [19]

Saito et al.

[11] 4,193,551

[45] Mar. 18, 1980

[54] MANUALLY OPERABLE ATOMIZER

[75] Inventors: Tadao Saito; Takamitsu Nozawa; Haruo Tsuchida; Shigeo Iizuka; Takayuki Goto, all of Tokyo, Japan

[73] Assignee: Yoshino Kogyosho Co., Ltd., Tokyo, Japan

[21] Appl. No.: 911,353

[22] Filed: Jun. 1, 1978

[30] Foreign Application Priority Data

Mar. 16, 1978 [JP] Japan ..... 53/33629[U]

[51] Int. Cl.[2] ..... B05B 9/043

[52] U.S. Cl. ..... 239/333; 222/321; 222/383

[58] Field of Search ..... 239/320, 329, 330, 331, 239/333, 340, 350; 222/321, 383, 385

[56] References Cited

U.S. PATENT DOCUMENTS

| | | | |
|---|---|---|---|
| 3,216,624 | 11/1965 | Corsette | 222/321 X |
| 3,282,474 | 11/1966 | Gorman | 239/331 X |
| 3,937,366 | 2/1976 | Steiman | 222/321 |
| 4,057,176 | 11/1977 | Horvath | 239/333 X |
| 4,132,359 | 1/1979 | Nozawa | 239/333 |

FOREIGN PATENT DOCUMENTS

| | | | |
|---|---|---|---|
| 2632662 | 1/1977 | Fed. Rep. of Germany | 239/333 |

*Primary Examiner*—Johnny D. Cherry

[57] ABSTRACT

A manually operable atomizer of a type adapted to pressurizing the liquid to be atomized by a pumping action of a piston, upon depression of the latter through an atomizing head, the liquid has been sucked up from a container, and atomizing the pressurized liquid from a nozzle. The atomizer has a flange annexed to a cylinder which is adapted to cooperate with the piston in performing the pumping action, a connecting member secured to a neck opening portion of the container and adapted to hold the flange and a holding member opposing to the connecting member and adapted to hold the flange, so that the atomizing mechanism including the piston and the cylinder are stably held on the container. The holding member is so shaped as to surround the connecting member, thereby to prevent any external force from acting on the flange.

6 Claims, 11 Drawing Figures

MANUALLY OPERABLE ATOMIZER

BACKGROUND OF THE INVENTION

1. Field of the Invention

The present invention relates to a manually operable atomizer having an atomizing means so associated with an atomizing head as to perform a pumping action upon, depression of the atomizing head, thereby to effect an atomization of a liquid through a nozzle.

2. Description of the Prior Art

In conventional atomizer of the kind described, the atomizing means have a cylinder provided with a flange which is adapted to be mounted on the opening ridge of a liquid container. For securing the atomizing means to the liquid container, the flange of the cylinder, mounted on the opening ridge of the container, is cramped by a holding sleeve from the outer side thereof.

According to this arrangement, the depression force exerted on the atomizing head, for forcing the atomizing means to perform a pumping action, is received solely by the flange. It is therefore preferred that the opening of the liquid container has a small diameter, because a too large diameter of the container opening in relation to the atomizing means renders the support for the atomizing means unstable, so as to hinder the smooth depressing operation of the atomizing head. Moreover, the too large diameter of the container opening often causes a leakage of the liquid through the joint area between the atomizing means and the liquid container, during a long use.

For the reasons as stated above, it has been proposed and attempted to make the diameter of the container opening small.

However, this countermeasure cannot be adopted suitably in such an atomizer as adapted to be used in both of ordinary and upside-down postures. This is because such an atomizer has a neck portion of a diameter large enough to accommodate two liquid suction pipes, one is for ascending of the liquid while the other is for descending of the same, and, accordingly, requires a container opening of a diameter large enough to receive the fat neck portion, posing the aforementioned problems.

The pumping type atomizers must have a container opening stiff enough to stand up against the large depression force exerted on the atomizing head, in sharp contrast to the aerosol type atomizers. The demand for the safe support of the atomizing head by the container opening is increasing recently.

SUMMARY OF THE INVENTION

Objects of the Invention

It is therefore a major object of the invention to provide an atomizer having a connecting member consisting of a double sleeve and disposed within the neck opening of the liquid container, the connecting members being adapted to carry the flange of a cylinder formed on the atomizing means, thereby to stably support the atomizing means.

It is another object of the invention to provide an atomizer having such a holding member, in addition to the above mentioned connecting member, as adapted to support the atomizing means on the neck opening of the liquid container in a stable and detachable manner and, at the same time, ensures good watertight seals between the flange and the connecting member and between the wall of the neck opening of the container and the connecting member.

It is still another object of the invention to provide an atomizer which affords, thanks to the combined use of the connecting member and the holding member, a standardization of the size of the flange on the cylinder of the atomizng means independently of the diameter of the neck opening of the liquid container, so as to allow the design and manufacture of the atomizing means irrespective to the size of the liquid container.

It is a further object of the invention to provide an atomizer in which the atomizing means and the liquid container are connected through engagement of annular ridges, so as to facilitate the mounting and dismounting of the atomizer and to make the connecting member and the holding member detachable together with the atomizing means.

It is a still further object of the invention to provide an atomizer having a liquid container consisting of a metallic can, so that the painting on the outer surface of the liquid container is facilitated.

It is a still further object of the invention to provide an atomizer in which the holding member is made to have such a configuration as to surround the connecting member, so as to prevent the flange of the atomizing means from being moved by the external force.

It is a still further object of the invention to provide an atomizer so designed and manufactured as not to allow the misalignment of the position of the nozzle of the atomizing head from the position of the window of the overcap.

DESCRIPTION OF THE PREFERRED EMBODIMENT

Figure 1:
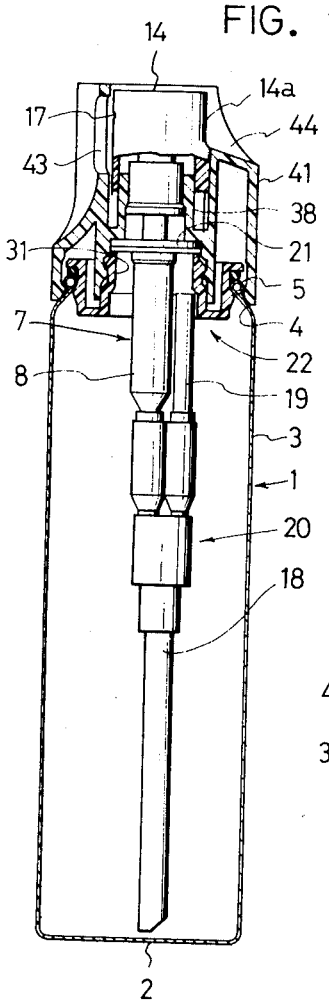
FIG. 1 is a longitudinal sectional view of a manually operable atomizer embodying the present invention.
Figure 2:
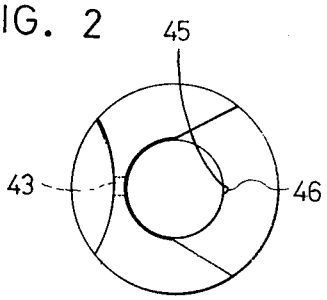
FIG. 2 is a plan view of the atomizer as shown in FIG. 1.
Figure 3:
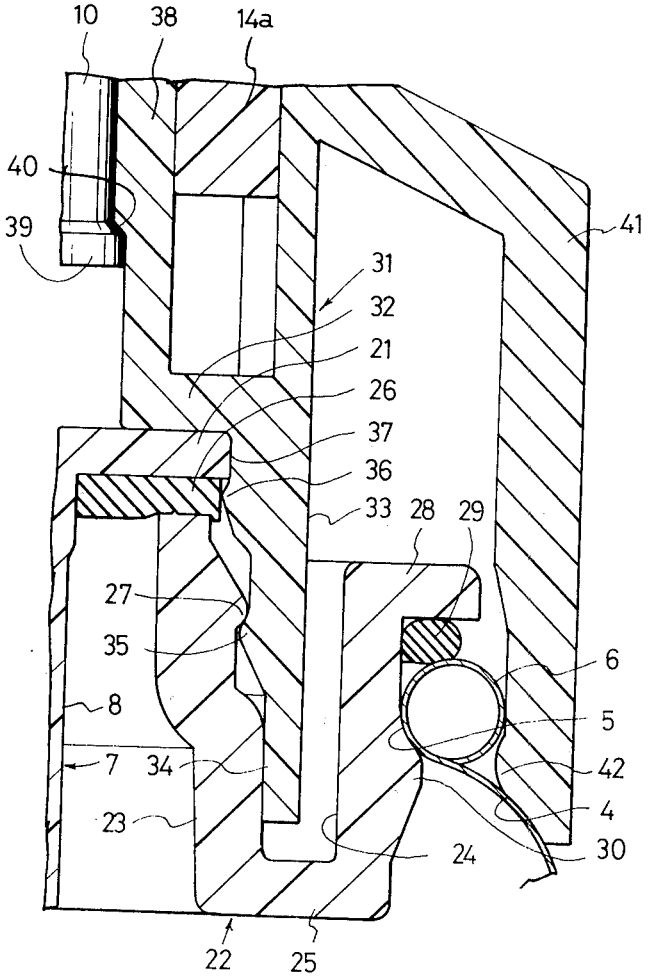
FIG. 3 is an enlarged sectional view of an essential part of the atomizer as shown in FIG. 1.
Figure 4:
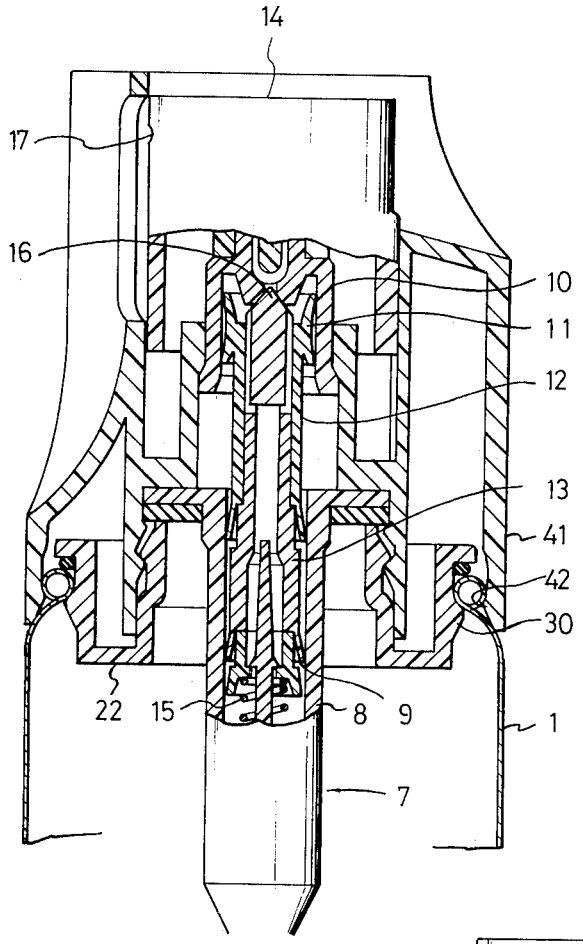
FIG. 4 is a sectional view of an essential part of the atomizer including a piston mechanism of the atomizing means.

Referring first to FIGS. 1 thru 4 showing a first embodiment of the invention, a container 1 accommodating the liquid to be atomized is made of a metal, and has portions starting from a bottom wall 2, barrel portion 3, shoulder portion 4 and a neck opening portion 5 of a diameter smaller than that of the barrel portion 3. The upper end brim (or rim) 6 of the neck opening portion 5 is curled to have a circular cross-section.

Atomizing means 7 have a lower portion received by the container 1 through the neck opening portion 5 of the latter, and is supported at its upper portion by the neck opening portion 5 of the container 1.

The atomizing means 7 under description have two pressurizing chambers, one is of a smaller diameter while the other is of a larger diameter. However, the provision of two pressurizing chambers is not exclusive, and the pressurizing means having only one pressurizing chamber can fairly be used.

The atomizing means 7 of the described embodiment are provided with a first pressurizing chamber section defined by a small-diameter cyclinder 8 and a cooperating small diameter piston 9, and a second pressurizing chamber section defined by a large diameter cylinder 10 and a cooperating large diameter piston 11. The first and the second pressurizing chamber sections communicate each other through a tubular plunger 12, and constitute a pessurizing chamber 13. The arrangement is such that the liquid in the pressurizing chamber 13 is pressurized as the atomizing head 14 is depressed overcoming the force of a spring 15, and the pressurized liquid is atomized from a nozzle 17 provided in the atomizing head 14, via an atomizing valve 16.

As the atomizing head is released from the depressing force, the pistons 9 and 10 of the small and large diameters are returned to the starting positions by the force of the spring 15. During this returning stroke of the pistons, the next batch of the liquid sucked up from the container 1 up to the pressurizing chamber 13, through a suction pipe 18 which leads to the suction port of the pressurizing chamber 13. Since the atomizer of the described embodiment is adapted to be used in both of ordinary posture and upside-down posture, another suction pipe 19 beside the first-mentioned suction pipe 18 is connected to the base portion of the suction pipe 18 through an auxiliary member 20 incorporating a three-way valve. Consequently, the lower portion of the atomizing means 7 is made to have a relatively large diameter, so that the neck opening portion 5 of the container has to have a correspondingly large diameter.

A flange 21 is formed at the upper end portion of the small diameter cylinder 8, and is extending laterally from the latter. The flange 21 is adapted to rest on the upper end of a connecting member 22 secured to the neck opening portion 5 of the container.

The top surface of the inner peripheral wall 23 constitutes an annular supporting surface which supports the aforementioned flange 21 through a medium of an annular packing 26. The upper portion of the inner peripheral wall 23 is made to have a smaller diameter than the lower portion of the same. An annular peripheral protrusion 27 is formed on the outer peripheral wall of the upper portion of the inner peripheral wall 23, and is adapted to engage an annular protrusion 35 formed on a later-mentioned holding member 31.

An outwardly extending flange 28 is formed on the upper end portion of the outer peripheral wall 24 of the connecting member 22. The flange 28 is mounted on the brim 6 of the neck opening portion 5 of the container, through a medium of an annular sealing member 29.

An annular protrusion 30 formed on the outer peripheral surface of the outer peripheral wall 24 is adapted to engage the neck opening portion 5 of the container at a part of the latter just below the brim 6, so as to cooperate with the flange 28 in firmly cramping the brim 6 therebetween, thereby to secure the connecting member 22 to the neck opening portion 5 of the container. The connecting member 22 is made of a plastic, so that the outer peripheral wall thereof can slightly be bent around its lower end, so that the connecting member 22 is detachably secured to the neck opening 5.

The flange 21 of the atomizing means, held by the upper end of the connecting member 22, is pressed from the upper side thereof by a flange 32 of the aforementioned holding member 31.

The holding member 31 has a cylindrical portion 33 extending downwardly from the outer end portion of the flange 32. The inner periphery of the cylindrical portion 33 has, from the lower end to the upper end thereof, a supporting surface 34 adapted to be fitted to the lower portion of the inner peripheral wall 23 of the connecting member 22, the aforementioned annular protrusion 35 adapted to engage the annular protrusion 27 of the inner peripheral wall 23, an annular protrusion 36 adapted to be contacted by the annular packing 26 and a bearing surface 37 adapted to bear against the outer peripheral surface of the flange 21.

The holding member 31 further hass a cylindrical portion 38 extending upwardly from the inner end of the flange 32. The cylindrical portion 38 slidably receives the large diameter cylinder 10 of the atomizing means 7. An annular projection 39 formed on the lower portion of the large diameter cylinder 10 is adapted to engage a step 40 formed on the inner peripheral surface of the cylindrical portion 38, so as to prevent the large diameter cylinder 10 from dropping out of the cylindrical portion 38.

An over cap 41 is formed as necessitated at the outer side of the cylindrical portion 38 of the holding member 31. An annular protrusion 42 for engagement with the brim 6 of the neck opening 5 of the container is formed on the inner peripheral surface of the lower portion of the over cap 41.

The over cap 41 is connected to the flange 32 through an extended flange, such that the lower portion of the over cap 41 can be spread or expanded outwardly around a fulcrum residing in the connecting area of the over cap with the flange 32, so as to afford an easy engagement and disengagement of the annular protrusion 42 with and from the brim 6. The portions of the over cap 41 corresponding to the nozzle 17 and the manipulating portion of the atomizing head 14 are formed as a window 43 or a recess 44.

The atomizing head 14 is surrounded by a cylindrical case **14*a* the lower portion of which is adapted to move up and down through the space defined by the cylindrical portion 38 of the holding member 31 and the over cap 41. A linear vertical protrusion 45 is formed on the case 14*a* of the atomizing head 14, and is adapted to be slidingly received and guided by a cooperating groove 46 formed in the surface of the cover cap 41**.

Consequently, the atomizing head 14 is never rotated with respect to the over cap 41, even when it is depressed strongly, thereby to keep the nozzle 17 in alignment with the window 43. Needless to say, it is possible to form the linear protrusion 45 and the cooperating groove 46 in the over cap 41 and in the case **14*a***, respectively.

At the same time, the metallic material of the container 1 is not exclusive and the latter 1 may be made of a plastic. Further, the stable support for the atomizing means 7 provided by the connecting member 22 and the holding member 31 in combination can be performed also for such an atomizing means as having only one cylinder associated with a piston.

In the foregoing embodiment, the connecting member 22 and the holding member 31 are held by each other by means of engagement of the annular protrusions 27, 35 and 36. However, this manner of holding by each other is not exclusive, and the connecting member 22 and the holding member 31 may be threaded so that they may be screwed to each other.

In the atomizer having the described construction, the flange 21 formed on the small diameter cylinder 8 is cramped between the connecting member 22 and the holding member 31 through an annular packing 26 and, therefore, is firmly held on the neck opening portion 5 of the container. Consequently, a smooth movement of the atomizing head 14 is ensured when the latter is depressed and, at the same time, the atomizer is relieved from the aforementioned troubles.

Namely, since the flange 21 is held by the connecting member 22 disposed at the inside of the neck opening 5 of the container, a stable support of the atomizing means is ensured even by the neck opening 5 of a relatively large diameter. In addition, it is not necessary to make the flange 21 for holding the atomizing means 7 specifically large to meet the large diameter of the neck opening 5. This considerably contributes to the mass production of the atomizing means.

In addition, since the connecting member 22 and the holding member 31 are secured to each other by means of the mutual engagement of the annular protrusions 27 and 36 or by means of the mutual engagement of the flange 21 and the annular protrusion 36, the cramping force for cramping the flange 21 is further enhanced.

At the same time, the annular protrusion 42 formed at the lower end portion of the over cap 41 engages the brim 6 of the neck opening 5, while the latter is cramped by the flange 28 and the annular protrusion 30 of the connecting member 22. Besides that, the supporting surface 34, in addition to the protrusions 35, 36, engages the inner peripheral wall 23 of the connecting member 22, so as to further stabilize the support of the flange 21. In this case, the mutual engagement of the annular protrusions formed on the connecting member 22 and the holding member 31 enhances the watertightness of the seals at the portion of the flange 21 where the annular packing 26 is provided and at the portion of the neck opening where the annular sealing member 29 is provided.

The combination of the connecting member 22 and the holding member 31 provides a stable support of the atomizing means 7, even when the diameter of the neck opening 5 of the container is made large enough to receive such a fat atomizing means 7 as having two suction pipes 18, 19 intended for use in both of ordinary and upside-down postures, as is the case of the described embodiment. In addition, the large diameter cylinder 10 is slidably held by the cylindrical portion 38 of the holding member 31. This means that the atomizing means 7 is held in a more stable manner at two portions thereof, i.e. at an upper portion and at a lower portion thereof.

It is also to be noted as one of the major advantages of the invention, that the annular protrusion 30 of the connecting member 22 and the annular protrusion 42 of the over cap 41 are withdrawn from the brim 6 of the neck opening 5 of the container, as the over cap 41 of the holding member 31 is pulled away from the container 1, so as to allow as easy separation of the atomizing means 7 together with the connecting member 22 and the holding member 31 from the container 1.

During this separation of the atomizing means 7 from the container 1, the outer peripheral wall 24 of the connecting member 22 is bent inwardly around the lower end thereof, while the lower portion of the over cap 41 is bent outwardly around the fulcrum residing in the extended flange portion.

After removing the atomizing means 7 from the container 1, the container 1 is again filled with the liquid and then the atomizing means 7 are again pressed into the neck opening 5 of the container 1 to bring the annular protrusions 30, 42 again into engagement with the brim 6, thus completing easily the refilling of the container 1.

At the same time, the container 1, which is a metallic can, affords an easy printing or the like on the surface thereof. In addition, since the depression of the atomizing head 14 is made in the stable and smooth manner without incurring a misalignment of the window 43 with the nozzle 17, the atomizing head 14 is prevented from rotating thanks to the guiding engagement of the linear protrusion 45 with the guiding groove 46.

Figure 5:
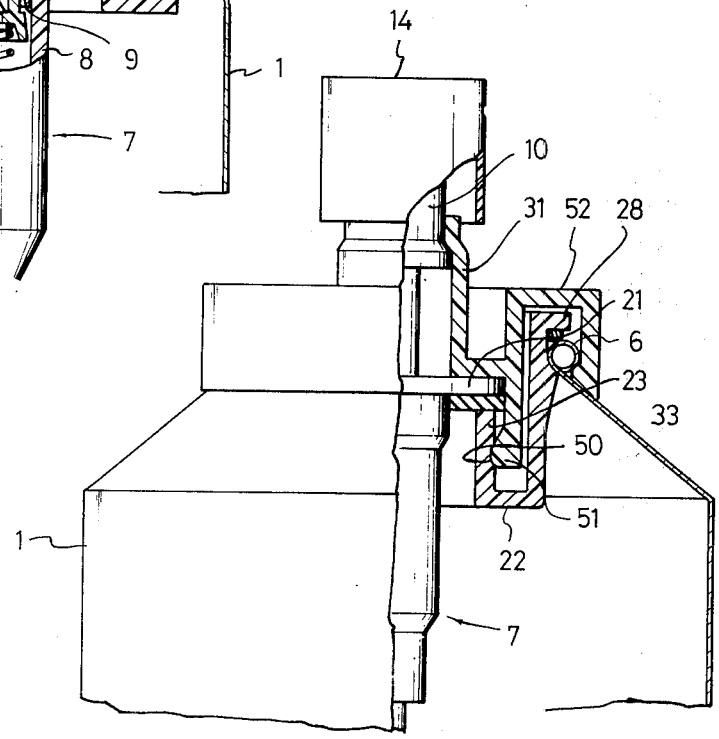
FIG. 5 is a fragmentary sectional view of an essential part of a manually operable atomizer of a second embodiment of the invention.

Referring now to FIG. 5 showing a second embodiment of the invention, the over cap which is annexed to the holding member 31 for enclosing the atomizing head 14 of the foregoing embodiment is neglected. At the same time, the mutual holding of the connecting member 22 and the holding member 31 is made by means of a sole annular protrusion. More specifically, an annular groove 50 is formed in the outer peripheral surface of the inner peripheral wall 23 of the connecting member 22, while an annular protrusion 51 adapted for engaging the annular groove 50 is formed on the cylindrical portion 33 of the holding member 31. The holding member 31 further has a flange 52 extending laterally from the upper end thereof. The arrangement is such that the laterally extending flange 52 cooperates with the brim 6 of the neck opening 5 of the container in cramping the flange 28 of the connecting member 22 therebetween. Other portions or parts than specifically mentioned above are all identical to those of the first embodiment, and are denoted by the same reference numerals.

Thus, the atomizer of the second embodiment has a simpler construction than the atomizer of the first embodiment, in that it is devoid of the over cap 41 enclosing the atomizing head 14 and that the connecting member 22 and the holding member 31 are secured to each other by means of a sole annular protrusion, but assures the stable support of the atomizing means 7 on the neck opening 5 of the large diameter and an easy attaching and detaching of the atomizing means 7 to and from the neck opening 5 of the container, as effectively as the first embodiment.

Figure 6:
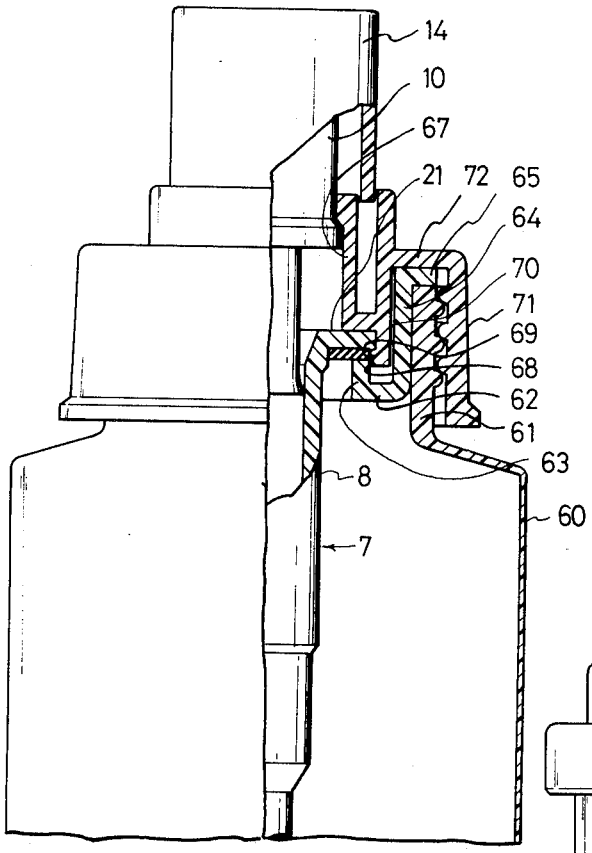
FIG. 6 is a fragmentary sectional view of an essential part of a manually operable atomizer of a third embodiment of the invention.

FIG. 6 shows a third embodiment of the invention in which the container 60 is made of a plastic or glass and the neck opening portion 61 is formed to have a cylindrical shape threaded at the outer surface thereof. The connecting member 62 has, similarly to the connecting member 22 of the first embodiment, an inner peripheral wall 63 and an outer peripheral wall 64, but has no annular protrusion. More specifically, the outer peripheral wall 64 of the connecting member 62 is adapted to contact the inner peripheral wall of the neck opening portion 61 of the container 60, while a flange 65 formed at the upper end of the outer peripheral wall 64 is adapted to rest on the upper end of the neck opening portion 61. The holding member 67 adapted to cramp the flange 21 formed on the small diameter cylinder 8 has a cylindrical portion 70 provided with a bearing surface 68 adapted to bear against the inner peripheral wall 63 and an annular protrusion 69 adapted to engage the flange 21, and a holding sleeve 71 provided with a thread for engagement with the thread of the neck opening 61 of the container.

The holding sleeve 71 is secured through an extending flange 72 which is adapted to cooperate with the upper end of the neck opening 61 of the container in cramping the flange 65 therebetween.

The atomizer of the third embodiment is devoid of the over cap enclosing the atomizing head 14, as is the case of the second embodiment. Other portions of the third embodiment than specifically mentioned above are materially identical to those of the first embodiment.

The connecting member 62 and the holding member 67 may be threaded for mutual screwing engagement, so as to further ensure the safe holding of these two members by each other.

The construction of the atomizer of this third embodiment, in which the atomizing means are secured to the container made of a plastic or the like material, is simpler than that of the atomizer of the first embodiment.

The atomizing means 7 can be separated from the container 60 by simply rotating the holding member. In this case, although the atomizing means 7 are disconnected from the connecting member 62, the holding member 67 can be detached from the container unitarily with the atomizing means 7, so as to facilitate the refilling of the container with the liquid.

Figure 7:
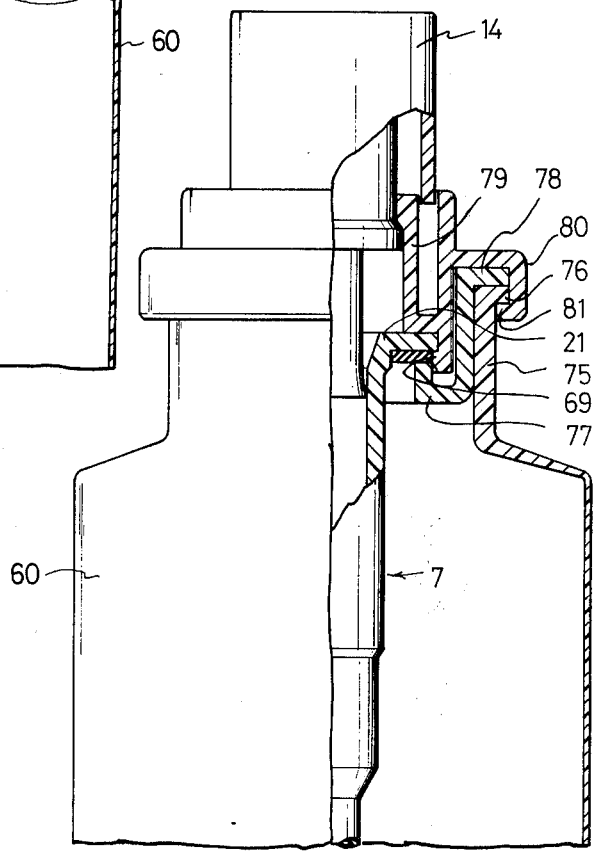
FIG. 7 is a fragmentary sectional view of an essential part of a manually operable atomizer of a fourth embodiment of the invention.

FIG. 7 shows a fourth embodiment of the invention in which the container is made of a plastic or the like material as is the case of the third embodiment. The container however has no thread around its neck opening portion 75, but is provided with an annular protrusion 76 formed on the outer peripheral surface of the upper end of the neck opening portion 75. The connecting member 77 has an outer peripheral flange 78 adapted to rest on the annular protrusion 76, while an annular protrusion 81 of a holding sleeve 80 provided on the holding member 79 is engaged by the lower face of the annular protrusion 76, so that the flange 78 may be firmly cramped. Other portions than specifically explained above are materially identical to those of the third embodiment.

Figure 8A:
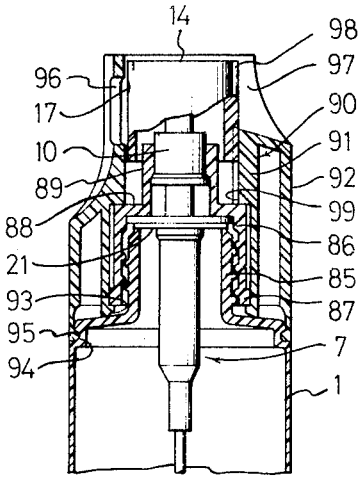
FIGS. 8A and 8B are a sectional view of an essential part of a manually operable atomizer of a fifth embodiment of the invention and an exploded perspective view of the same essential part.
Figure 8B:
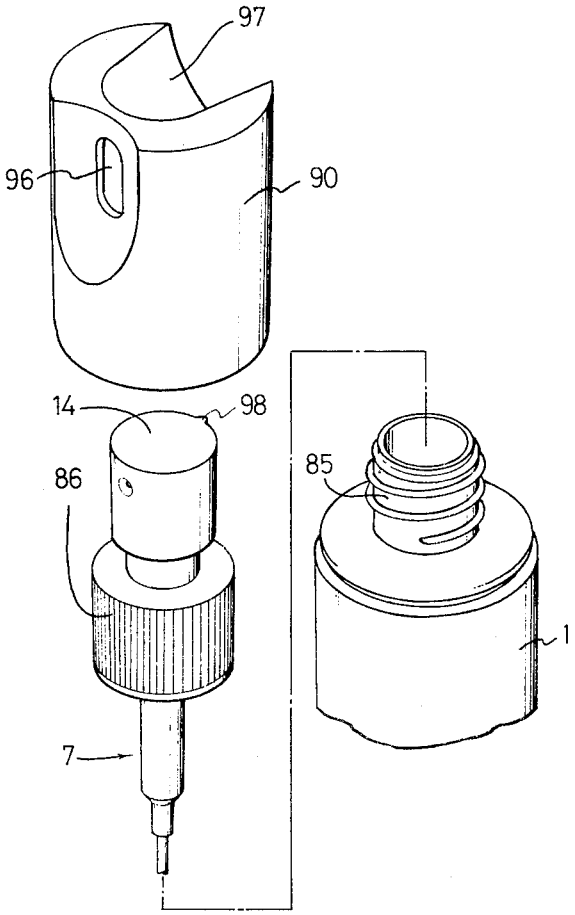

Referring now to FIGS. 8A and 8B showing a fifth embodiment of the invention, the container is made of a plastic or the like material and has a threaded neck opening portion 85. The flange 21 of the atomizing means 7 is adapted to be directly mounted on the upper end of the neck opening portion 85 of the container. The connecting member 86 has a cylindrical portion 87 adapted for a screwing engagement with the neck opening portion 85, a flange 88 adapted to cramp the flange 21, and a holding sleeve 89 adapted to slidingly receive the large diameter cylinder 10 of the atomizing means 7. The holding member 90 adapted to cover the atomizing head 14 and the connecting member 86 is provided with an inner peripheral wall 91 and an outer peripheral wall 92. The inner peripheral wall 91 has an annular protrusion 93 adapted for engagement with the lower end of the connecting member 86, while the outer peripheral wall 92 has an annular protrusion 95 adapted to be received by an annular groove 94 formed in the upper end portion of the container.

A window 96 is formed through the wall of the holding member 90 at an upper portion of the latter confronting the nozzle 17 of the atomizing head 14. At the same time, the portion of the holding member 90 corresponding to the manipulating portion of the atomizing head 14 is recessed as at 97.

The atomizing head 14 and the holding member 90 are provided with a linear protrusion 98 and a cooperating groove 99 for slidingly guiding the linear protrusion 98, respectively, as is in the first embodiment. Other portions than specifically mentioned above are materially identical to those of the first embodiment. As has been stated before, the atomizing means can have only one cylinder or, alternatively, a small and a large diameter cylinders, as is in the case of the foregoing embodiments.

In the atomizer having the described construction, the flange 21 of the atomizing means is placed on the neck opening 5 of the container, and is cramped firmly between the connecting member 86 and the neck opening. In addition, since the holding member 90 is provided at the outside of the connecting member, the holding of the atomizing means is protected against any external force and, accordingly, is kept in good order.

This holding is stabilized because the ordinary force does not act on the flange.

For removing the atomizing means 7 from the container, the annular projection 93 is disengaged from the connecting member 86 and, further, the annular protrusion 95 is forced out of the annular groove 94, as the holding member 90 is pulled, so that the latter is separated from the container. Then, as the connecting member 86 is rotated, the atomizing means 7 are removed from the container together with the connecting member 86, since the large diameter cylinder 10 thereof is firmly held by the connecting member 86. Consequently, the refilling of the container with the liquid to be atomized can be carried out in quite an easy manner, without necessitating the disassembling of the constituents.

Figure 9A:
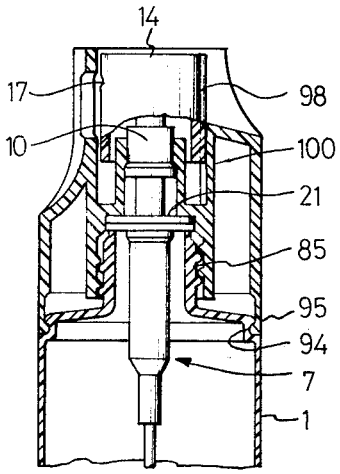
FIGS. 9A and 9B are a sectional view of an essential part of a manually operable atomizer of a sixth embodiment of the invention and an exploded perspective view of the same essential part.
Figure 9B:
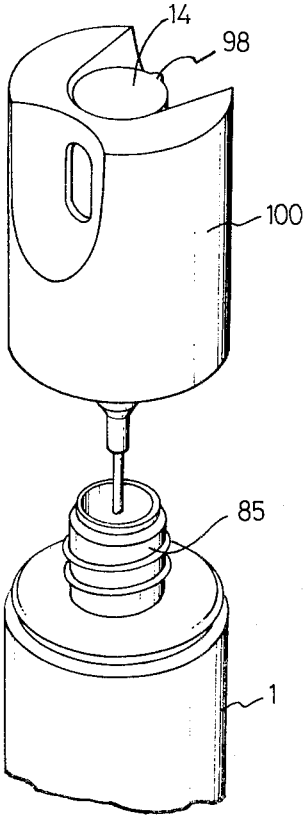

FIG. 9A and FIG. 9B in combination shows a sixth embodiment of the invention in which the connecting member 86 and the holding member 90 of the fifth embodiment are made unitary with each other to form an integral holding sleeve 100 and, accordingly, the annular projection 93, which is used in the fifth embodiment for attaining the mutual engagement of the connecting member and the holding member, is neglected from this sixth embodiment. Other portions than specifically mentioned above are materially identical to those of the fifth embodiment.

Consequently, the holding sleeve 100 provides a stable support for the atomizing means. At the same time, a simple rotation of the holding sleeve 100 will cause an upward movement of the same, which in turn causes the annular protrusion 95 to be disengaged from the annular groove 94, so as to allow an easy separation of the atomizing means along with the holding sleeve from the container.

What is claimed is:

1. A manually operable atomizer of the type having a container containing a liquid to be atomized, an atomizing means adapted to be held by the neck opening portion of said container, said atomizing means including a pressurizing chamber defined by a cylinder and a piston which are adapted to make a pumping action, an atomizing head through which said piston is depressed and actuated, and a nozzle through which said liquid pressurized in said pressurizing chamber is atomized, comprising:

a connecting member disposed in said neck opening portion of said container and having an inner peripheral wall and an outer peripheral wall connected to each other at their lower ends, said connecting member having a first flange formed at the upper end of said outer peripheral wall and adapted to rest on the top brim of said neck opening portion, the upper end of said inner peripheral wall constituting an annular supporting surface, said connecting member having a first annular protrusion formed on the outer peripheral surface of said inner peripheral wall of said member, and a second annular protrusion formed on the outer peripheral wall below said first flange for engagement with the inside top rim of the container; a holding member attached to said neck opening portion of said container and having a second flange adapted to face said annular supporting surface of said connecting member, a first cylindrical portion adapted to be fitted to the outer peripheral surface of said inner peripheral wall of said connecting member, and an over cap adapted to cover said atomizing head, said over cap having a third annular protrusion formed at its lower end portion and adapted for engagement with a top brim of said neck opening portion, said over cap further having a window formed at its portion corresponding to said nozzle of said atomizing head, said holding member having a fourth annular protrusion formed on said first cylindrical portion of itself for engagement with the first annular protrusion; a third flange extending laterally from the outer periphery of said cylinder and adapted to be cramped between said second flange and said annular supporting surface; and an annular packing adapted to be interposed between said annular supporting surface and said third flange; whereby said atomizing means are stably held, and are easily removed from the container and assembled.

2. A manually operable atomizer of the type having a container containing a liquid to be atomized, an atomizing means adapted to be held by the neck opening portion of said container, said atomizing means including a pressurizing chamber defined by a cylinder and a piston which are adapted to make a pumping action, an atomizing head through which said piston is depressed and actuated, and a nozzle through which said liquid pressurized in said pressurizing chamber is atomized, comprising:

a connecting member disposed in said neck opening portion of said container and having an inner peripheral wall and an outer peripheral wall connected to each other at their lower ends, said connecting member having a first flange formed at the upper end of said outer peripheral wall and adapted to rest on the top rim of said neck opening portion, the upper end of said inner peripheral wall constituting an annular supporting surface;

a holding member attached to said neck opening portion of said container and having a second flange adapted to face said annular supporting surface of said connecting member and a first cylindrical portion adapted to be fitted to the outer peripheral surface of said inner peripheral wall of said connecting member;

a third flange extending laterally from the outer periphery of said cylinder and adapted to be cramped between said second flange and said annular supporting surface; and an annular packing adapted to be interposed between said annular supporting surface and said third flange;

wherein, said container is made of a plastic or glass with the outer periphery of said neck opening portion of said container being threaded at its outer side, said holding member having a fourth flange adapted to contact said first flange and a second cylindrical portion which is connected to the outer periphery of said fourth flange, said second cylindrical portion having threaded grooves for engagement with said thread of said neck opening portion of said container, and said first cylindrical portion of said holding member having a protrusion adapted for engagement with the lower face of said third flange.

3. A manually operable atomizer of the type having a container containing a liquid to be atomized, an atomizing means adapted to be held by the neck opening portion of said container, said atomizing means including a pressurizing chamber defined by a cylinder and a piston which are adapted to make a pumping action, an atomizing head through which said piston is depressed and actuated, and a nozzle through which said liquid pressurized in said pressurizing chamber is atomized, comprising:

a connecting member disposed in said neck opening portion of said container and having an inner peripheral wall and an outer peripheral wall connected to each other at their lower ends, said connecting member having a first flange formed at the upper end of said outer peripheral wall and adapted to rest on the top rim of said neck opening portion, the upper end of said inner peripheral wall constituting an annular supporting surface;

a holding member attached to said neck opening portion of said container and having a second flange adapted to face said annular supporting surface of said connecting member and a first cylindrical portion adapted to be fitted to the outer peripheral surface of said inner peripheral wall of said connecting member;

a third flange extending laterally from the outer periphery of said cylinder and adapted to be cramped between said second flange and said annular supporting surface; and an annular packing adapted to be interposed between said annular supporting surface and said third flange;

wherein said container is made of a plastic and said neck opening portion is provided with an annular protrusion on its outer peripheral surface, said holding member has a fourth flange adapted to be pressed onto said first flange and a second cylindrical portion which is connected to the outer periphery of said fourth flange, said second cylindrical portion has an annular protrusion adapted for engagement with said annular protrusion on said neck opening portion, so as to hold said first flange against said neck opening portion in a watertight manner, and said first cylindrical portion of said holding member has a protrusion for engagement with the lower surface of said third flange.

4. A manually operable atomizer as claimed in claim 3, wherein said inner peripheral wall of said connecting member is threaded at its outer peripheral surface, while a mating threaded groove is formed on said first cylindrical portion of said holding member.

5. A manually operable atomizer of the type having a container containing a liquid to be atomized, an atomizing means adapted to be held by the neck opening portion of said container, said atomizing means including a pressurizing chamber defined by a cylinder and a piston which are adapted to make a pumping action, an atomizing head through which said piston is depressed and actuated, and a nozzle through which said liquid pressurized in said pressurizing chamber is atomized, comprising:

a first flange annexed to said cylinder and adapted to be mounted on the top brim of said neck opening portion of said container;

a connecting member screwed to said neck opening portion of said container and having a second flange adapted to cooperate with said top brim of said neck opening portion in cramping said first flange therebetween, and a guiding sleeve adapted to slideably hold said atomizing head; and a holding member formed integrally with said connecting member covering said connecting member and said atomizing head, and having an annular protrusion engageable with said container, whereby said atomizing head is stably held on said neck opening portion of said container.

6. A manually operable atomizer of the type having a container containing a liquid to be atomized, an atomizing means adapted to be held by the neck opening portion of said container, said atomizing means including a pressurizing chamber defined by a cylinder and a piston which are adapted to make a pumping action, an atomizing head having an operating portion through which said piston is depressed and actuated, and a nozzle through which said liquid pressurized in said pressurizing chamber is atomized, comprising:

a first flange annexed to said cylinder and adapted to be mounted on the top rim of said neck opening portion of said container;

a connecting member screwed to said neck opening portion of said container and having a second flange adapted to cooperate with said top rim of said neck opening portion in cramping said first flange therebetween, and a guiding sleeve adapted to slideably hold said atomizing head; and a holding member covering said connecting member and said atomizing head, and having an annular protrusion engageable with said container, wherein said holding member is formed to include a cap adapted to cover the portions of said atomizing head other than said nozzle and the operating portion, wherein one of said atomizing head and said cap is provided with a linear protrusion extending in the axial direction of said cylinder, while the other is provided with a linear groove adapted to slidingly guide said linear protrusion, thereby preventing said atomizing head from rotating in relation to said container.

* * * * *